US005257030A

United States Patent [19]

Aoki et al.

[11] Patent Number: 5,257,030

[45] Date of Patent: Oct. 26, 1993

[54] ANTENNA SYSTEM

[75] Inventors: Toshihiko Aoki; Takashi Katagi; Nobutake Orime; Susumu Hishinuma; Koushi Ogiso; Yasuhiko Nishioka, all of Kanagawa, Japan

[73] Assignee: Mitsubishi Denki Kabushiki Kaisha, Tokyo, Japan

[21] Appl. No.: 27,926

[22] Filed: Mar. 5, 1993

Related U.S. Application Data

[63] Continuation of Ser. No. 762,647, Sep. 19, 1991, abandoned, which is a continuation of Ser. No. 526,691, May 21, 1990, abandoned, which is a continuation of Ser. No. 246,858, Sep. 20, 1988, abandoned.

[30] Foreign Application Priority Data

Sep. 22, 1987 [JP] Japan ..... 62-238414

[51] Int. Cl.[5] ..... H01Q 3/22; H01Q 3/24

[52] U.S. Cl. ..... 342/368; 342/372; 342/377

[58] Field of Search ..... 342/368, 371, 372, 377, 342/196, 370

[56] References Cited

U.S. PATENT DOCUMENTS

| | | | |
|---|---|---|---|
| H375 | 11/1987 | Dinger . | |
| 3,394,374 | 7/1968 | Weiss . | |
| 3,887,923 | 6/1975 | Hendrix | 342/196 |
| 4,160,975 | 7/1979 | Steudel | 342/377 |
| 4,350,982 | 9/1982 | Alpers . | |
| 4,488,155 | 12/1984 | Wu | 342/376 |
| 4,656,479 | 4/1987 | Kirimoto et al. . | |
| 4,686,533 | 8/1987 | Mac Donald et al. | 342/373 |

FOREIGN PATENT DOCUMENTS 072986 10/1981 United Kingdom .
167626 5/1986 United Kingdom .

OTHER PUBLICATIONS

Wallington et al; "Optical Techniques for Signal Distribution in Phased Arrays" 645 G.E.C. Journal of Research 2(1984) No. 2 London, Great Britain.

Ruvin et al; Digital Multiple Beamforming Techniques for Radar; Sep. 1978; pp. 152-163; Conf Eascon '78.

Swartzlander, Jr et al; Digital Beam Forming Processor; 1980; SPIE vol 241 Realtime Signal Processing pp. 232-237.

Steyskal, "Digital Beamformig Antennas-An Introduction", Microwave Journal No. 30 vol. 1, Jan. 1987.

B. Wardrop, The Role of Digital Processing in Radar Beamforming.

IEEE Military Communications Conference, Conference Record vol. 2 of 3, Oct. 5-9, 1986; Contarino et al "Fiber Optic Communication Links for Millimeter Wave Phased Array Antennas".

*Primary Examiner*—Gregory C. Issing
*Attorney, Agent, or Firm*—Wolf, Greenfield & Sacks

[57] ABSTRACT

An antenna system for transmitting radio waves in the same direction as the direction of arrival of incoming radio waves. The arrival direction is detected by a fast Fourier transform processor. The transmitting direction is adjusted by phase-shifting radio waves from a feeder on the basis of the detected arrival direction. Further, signals in the system are transmitted through optical fibers in order to decrease the processing time.

4 Claims, 3 Drawing Sheets

SIGNAL PROCESS-OR
8
ELECTRO-OPTICAL CONVER-TER
5c
6c
PHOTO-ELECTRIC CONVER-TER
7c
PHOTO-ELECTRIC CONVERTER
7a
PHOTO-ELECTRIC CONVERTER
7b
FEED
10
REGIS-TER
9a
REGIS-TER
9b
6a
6b
PHASE-SHIFTER
11a
PHASE-SHIFTER
11b
ELECTRO-OPTICAL CONVER-TER
5a
ELECTRO OPTICAL CONVER-TER
5b
TRANS-MITTER
12a
TRANS-MITTER
12b
A/D CONVER-TER
4a
A/D CONVER-TER
4b
DUPLEX-ER
2a
DUPLEX-ER
2b
RECEIV-ER
3a
RECEIV-ER
3b
1a
1b
15a
15b
13
14

ANTENNA SYSTEM

This application is a continuation of application Ser. No. 07/762,647, filed Sep. 19, 1991, which in turn is a continuation of application Ser. No. 07/526,691, filed May 21, 1990, which in turn is a continuation of application Ser. No. 07/246,858, filed Sep. 20, 1988, all of which are now abandoned.

BACKGROUND OF THE INVENTION

1. Field of the Invention

The present invention relates to an antenna system having retrodirective characteristics in which beams of radio waves to be transmitted are automatically radiated in the direction of arrival of incoming radio waves.

2. Description of the Prior Art

In FIG. 1, which represents a block diagram of a conventional antenna system, the reference symbols 1*a* to 1*d* represent transmitting/receiving element antennas; 2*a* to 2*d* duplexers for separating transmitted radio waves and received radio waves; 13 the direction of arrival of incoming radio waves; 14 an equiphase front (equiphase wave surface) of the incoming radio waves arriving from the direction of arrival 13 of the incoming radio waves received when the element antenna 1*a* is the reference; (15*a*) to (15*d*) distances from the equiphase front 14 to each of the element antennas 1*a* to 1*d*; and 16*a* through 16*d* represent amplifiers for amplifying the incoming radio waves and for providing the radio waves to be transmitted.

A description will now be given of the operation. The incoming radio waves received from the direction of arrival 13 thereof are received by the element antenna 1*a* and are delivered via the duplexer 2*a* to the amplifier 16*b*. The incoming radio waves are amplified by the amplifier 16*b*, and then provided as radio waves to be transmitted. The thus formed radio waves to be transmitted travel through the duplexer 2*d* and are then transmitted from the element antenna 1*d*. Similarly, the incoming radio waves received by the element antenna 1*c* travel via the duplexer 2*b*, the amplifier 16*d* and the duplexer 2*c*, and are then transmitted from the element antenna 1*c*. The incoming radio waves received by the element antenna 1*c* pass through the duplexer 2*c*, the amplifier 16*c* and the duplexer 2*b*, and are transmitted from the element antenna 1*b*. The incoming radio waves received by the element antenna 1*d* travel via the duplexer 2*d* and the amplifier 16*a*, and are radiated from the element antenna 1*a* through duplexer 2*a*. The electrical characteristics of each system are substantially the same, and the element antennas 1*a* through 1*d* are arranged in symmetry with respect to the central line 21. Hence, distances of arrival (15*a*) to (15*d*) from the equiphase front 14 based on the element antenna 1*a* to the individual element antennas 1*a* to 1*d* are expressed by the following formulae:

$$(15a)[=0]+(15d)=(15d) \quad (1)$$

$$(15b)+(15c)=(15d) \quad (2)$$

When the incoming radio waves travel the arrival distance (15*d*) from the equiphase front 14 and are received by the element antenna 1*d* and then transmitted from the element antenna 1*a*, the delay in each system is ignored here because all the electrical characteristics of the respective systems are substantially equal to each other, and the radio waves received by the element antenna 1*a* and transmitted from the element antenna 1*d* travel a distance corresponding to the arrival distance (15*d*) from the element antenna 1*d* [(15*a*)=0]. Similarly, the radio waves which are received by the element antenna 1*b* and transmitted from the element antenna 1*c* travel the arrival distance (15*d*) from the equiphase front 14 during the same time period. It is therefore apparent from the formula 2 that the radio waves have travelled the distance corresponding to the arriving distance (15*c*) from the element antenna 1*c*. At the same time, the radio waves which are received by the element antenna 1*c* and transmitted from the element antenna 1*b* travel the arrival distance (15*d*) from the equiphase front 14. Hence, it follows from the formula 2 that the radio waves reach a position spaced apart from the element antenna 1*b* by the arrival distance (15*b*).

The situation with respect to the equiphase front of the radio waves to be transmitted is the same as the equiphase front 14 of the incoming radio waves arriving from the direction of arrival thereof. Namely, the radio waves transmitted travel the arrival distance (15*a*)[=0] from the element antenna 1*a*; the arrival distance (15*b*) from the element antenna 1*b*; the arrival distance (15*c*) from the element antenna 1*c*; and the arrival distance (15*d*) from the element antenna 1*d*. Hence, the transmitted beams can be automatically radiated in the same direction as the direction of arrival 13 of the radio waves.

In the thus arranged conventional antenna system, all the electrical characteristics of each part of the system are required to be equal to each other. Therefore, the frequency of the transmitted radio waves has to be equalized with that of the incoming radio waves. A problem arises, however, in that the incoming radio waves interfere with the transmitted ones if the frequencies thereof are equalized. In order to obviate this problem, it is required that the frequency of the transmitted radio waves is different from that of the incoming radio waves. However, the electrical characteristics in the receiving mode differ from those in the transmitting mode. As a result, another problem occurs because the beams of transmitted radio waves cannot be automatically radiated in the direction of arrival 13 of the incoming radio waves, since the equiphase front of the incoming radio waves arriving in the direction of arrival 13 thereof does not coincide with the equiphase front of the transmitted radio waves.

SUMMARY OF THE INVENTION

It is a primary object of the present invention to obviate the above-described problems and to provide an antenna system in which beams of transmitted radio waves can be automatically radiated in the direction of arrival of incoming radio waves even if the frequency of the incoming radio waves differs from that of the transmitted radio waves.

To this end, according to one aspect of the invention, there is provided an antenna system comprising: a plurality of transmitting/receiving element antennas; a phase-shifter installed in a transmitting system (or path) of the plurality of transmitting/receiving element antennas; a analog-to-digital converter installed in a receiving system for converting an incoming signal into a digital signal; and a signal processor installed likewise in the receiving system for digitally processing an incoming digital signal delivered from each element.

The analog-to-digital converter according to the present invention serves to convert an incoming signal into a digital signal so as to permit the signal processor to effect digital processing. The signal processor detects the direction of arrival of the incoming radio waves on the basis of the incoming digital signal derived from the signals received by each element antenna and calculates control signals for each transmitting system so that the beams of transmitted radio waves are radiated in the direction of arrival of the incoming radio waves. The phase-shifter provided in each transmitting system is intended to control an equiphase front of transmitted radio waves radiated from each element antenna on the basis of a control signal.

With such an arrangement, even when the frequency of the transmitted radio waves differs from that of the incoming radio waves, the beams of transmitted radio waves can be radiated in the direction of arrival of the incoming radio waves.

The foregoing and other objects and advantages of the invention will become more apparent upon reading the following discussion with reference to the accompanying drawings.

DETAILED DESCRIPTION OF THE PREFERRED EMBODIMENTS

Figure 1:
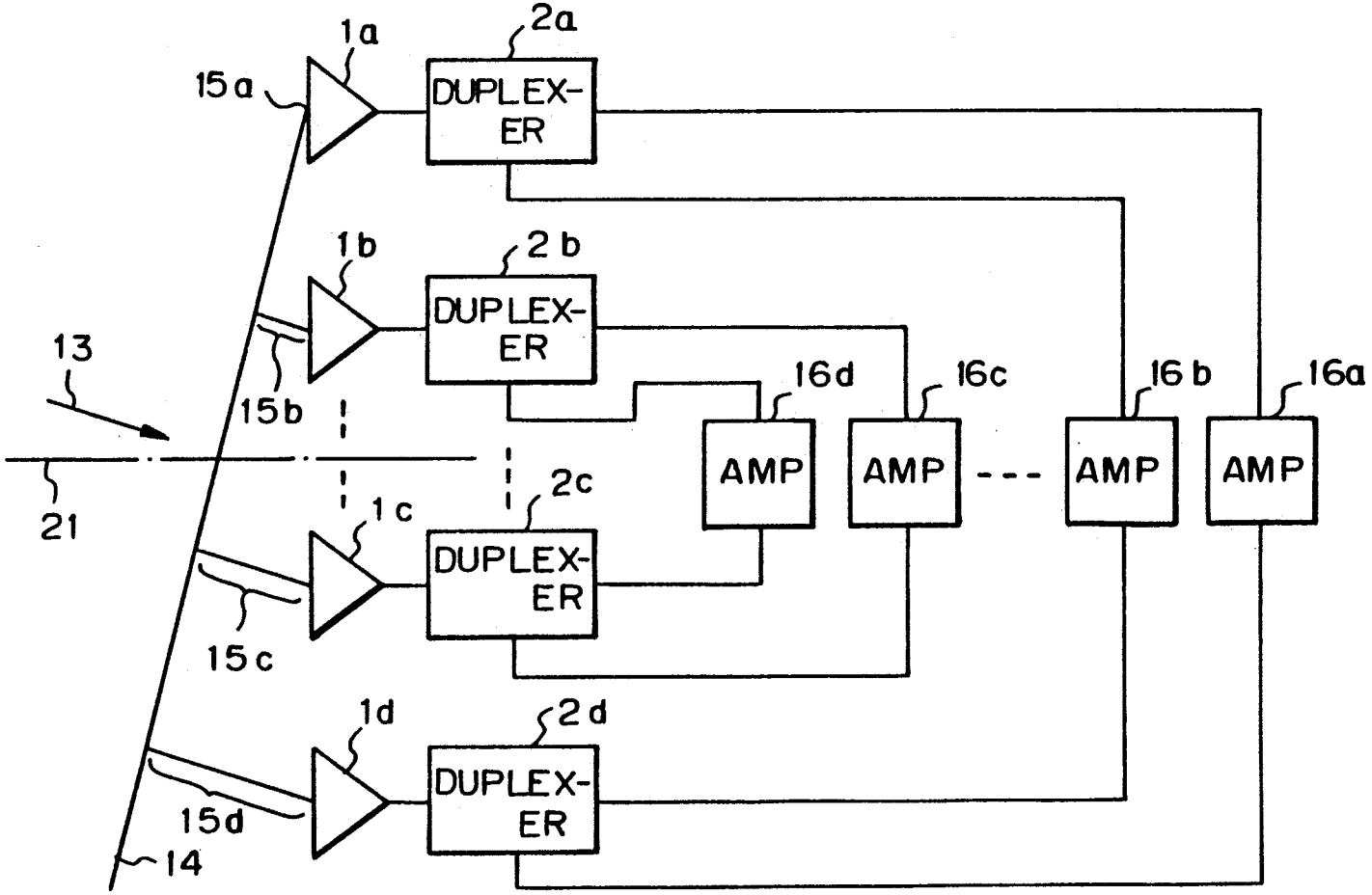
Fig. 1 PRIOR ART
FIG. 1 is a block diagram illustrating a prior art antenna system.
Figure 2:
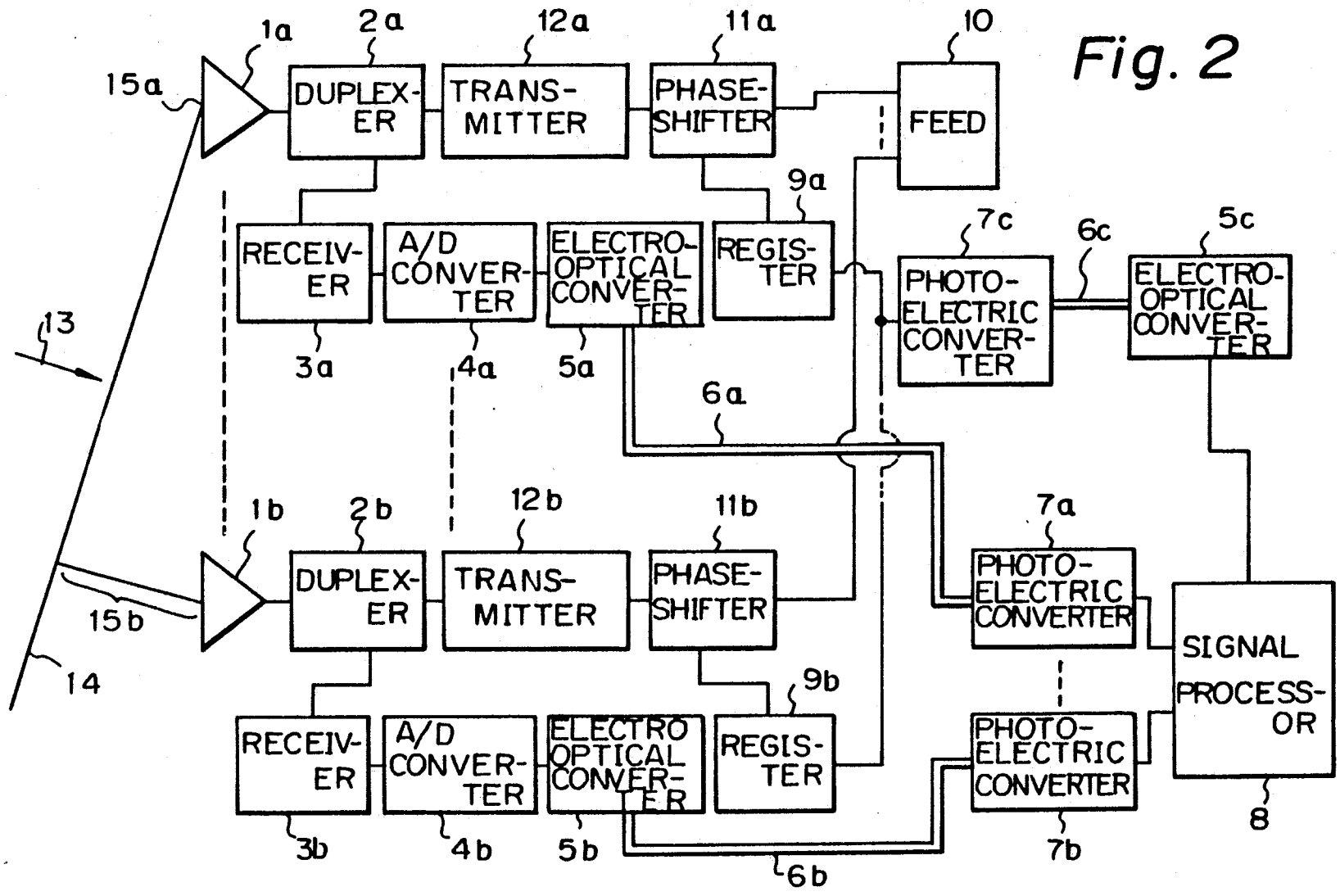
FIG. 2 is a block diagram illustrating one embodiment of the present invention.
Figure 3:
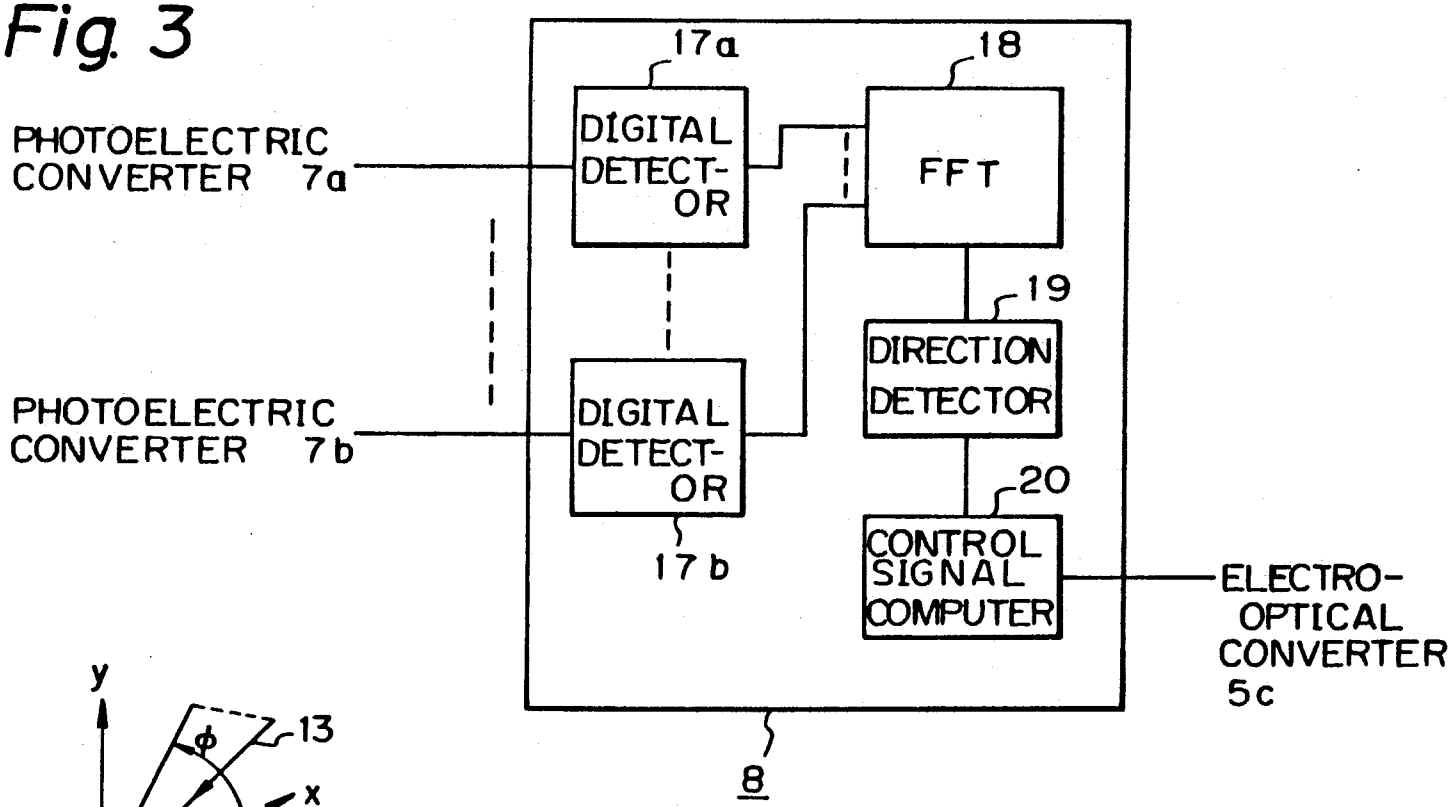
FIG. 3 is a block diagram of the signal processor depicted in FIG. 1.

Referring to FIG. 2, the reference symbols 1*a* and 1*b* represent transmitting/receiving element antennas; 2*a* and 2*b* designate duplexers for separating transmitted radio waves and incoming radio waves; 3*a* and 3*b* denote receivers; 4*a* and 4*b* designate analog-to-digital converters for converting the incoming signals from the receivers 3*a* and 3*b* into digital signals; 5*a* and 5*b* indicate electro-optical converters for converting electric signals into optical signals in order to transfer the signals from the analog-to-digital converters 4*a* and 4*b* at high velocity through optical fibers 6*a* and 6*b* to photoelectric converters 7*a* and 7*b* which convert the optical signals transmitted through the optical fibers 6*a* and 6*b* at high velocity into electric signals; 8 denotes a signal processor. The signal processor, as shown in FIG. 3, comprises digital detecting circuits 17*a* and 17*b*, which detect phases and amplitudes on the basis of the digital signals received from the element antennas 1*a* and 1*b* via the optical fibers 6*a* and 6*b*; an FFT (Fast Fourier Transform) circuit 18 for computing intensities of incoming radio waves in all directions on the basis of the phases and the amplitudes which are detected by the digital detecting circuits 17*a* and 17*b*; an incoming radio wave arrival direction detecting circuit 19 for detecting arriving the direction of arrival 13 of incoming radio waves, i.e., the direction of the incoming radio waves having the maximum intensity among the intensities of incoming radio waves arriving in all directions which are detected by the FFT circuit 18; and a control signal computing circuit 20 for computing control signals that are utilized to control the phases of the radio waves radiated from the element antennas 1*a* and 1*b* so as to make the beams of transmitted radio waves correspond to the direction of arrival 13 of the incoming radio waves detected by the direction detecting circuit 19. An electro-optical converter 5*c* converts the electric signal computed by the signal processor for each transmitting system into an optical signal which serves to transmit the control signals at high velocity through an optical fiber 6*c* to a photoelectric converter 7*c* which converts the optical signal transmitted at high speed into an electric signal. Registers 9*a* and 9*b* hold the control signals to be provided to each transmitting system. Phase-shifters 11*a* and 11*b* are adapted to the frequencies of the transmitted radio waves for controlling the equiphase front of the transmitted radio waves radiated from the element antennas 1*a* and 1*b* by controlling the phases of the transmitted radio waves supplied from a feed system 10 on the basis of the control signals stored in the registers 9*a* and 9*b*. Transmitters 12*a* and 12*b* amplify the transmitted radio waves the phases of which are controlled by the phase-shifters 11*a* and 11*b* and eliminate unnecessary radio waves. The reference number 13 indicates the direction of arrival of incoming radio waves, 14 denotes an equiphase front of the incoming radio waves arriving from the direction of arrival 13 thereof with the element antenna 1*a* serving as a reference, and (15*a*) and (15*b*) represent arrived distances from the equiphase front 14 to the respective element antennas 1*a* and 1*b*.

Next, the operation will be explained. The incoming radio waves approaching from the arrival direction 13 are received by the element antennas 1*a* and 1*b*. Subsequently, the received radio waves are transferred via the duplexers 2*a* and 2*b* to the receivers 3*a* and 3*b*. The receivers 3*a* and 3*b* serve to detect incoming signals from the received radio waves. The incoming signals are converted into digital signals by means of the analog-to-digital converters 4*a* and 4*b* preparatory to a step of undergoing digital processing by use of the signal processor 8, thus becoming incoming digital signals. The digital signals received are further converted into optical signals by the electro-optical converters 5*a* and 5*b* for the purpose of transmitting these signals to the signal processor 8 at a high velocity exceeding the limit of electrical transmission. In this case, the transmission of optical signals involves the use of the optical fibers 6*a* and 6*b*. The optical signals are converted into electric signals by the photoelectric converters 7*a* and 7*b* just before being fed to the signal processor 8. The digital detecting circuits 17*a* and 17*b* in the signal processor 8 detect phases and amplitudes of the receiving radio waves from the element antennas 1*a* and 1*b*, which phases and amplitudes correspond to the arrival distances 15*a* and 15*b* from the equiphase front 14 of the element antennas 1*a* and 1*b*, on the basis of the received digital signals delivered from the element antennas 1*a* and 1*b* through the optical fibers 6*a* and 6*b*. Based on the phases and the amplitudes detected by the digital detecting circuits 17*a* and 17*b*, the FFT circuit 18 computes the intensities of the incoming radio waves in every direction in conformity with the following formula (1):

$$E_l = \sum_{i=1}^{n} A_i \cdot e^{jk\psi i} \tag{1}$$

where n is the number of element antennas 1*a* and 1*b*; $A_i$ is the amplitude detected by the digital detecting circuits 17a and 17b; $\psi_i$ is the phase detected by the digital detecting circuits 17a and 17b; $e^j$ is the complex number; $k_1$ is the constant determined by the frequency of the incoming radio waves; and $E_l$ is the intensity of the incoming radio waves in each direction; here $l=1$ to n, $E_l$ ($l=1$ to n) indicates the intensity of the incoming radio waves in each direction which is given by equally dividing all directions of the space by n. The $E_l$ is calculated by the Fast Fourier Transform (FFT) circuit 18.

Figure 4:
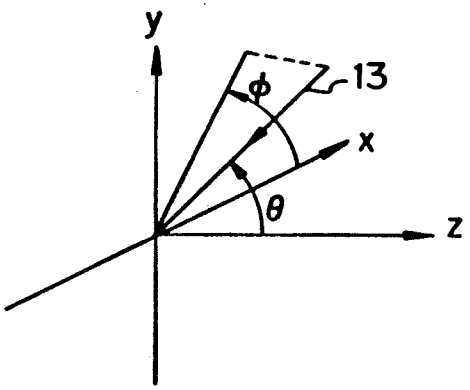
FIG. 4 is a diagram of a coordinate system showing the direction of arrival of incoming radio waves.

The incoming radio wave arrival direction detecting circuit 19 detects the direction of arrival 13 of the incoming radio waves, i.e., the direction having the maximum intensity among the intensities $E_l$ of incoming radio waves in each direction, which are computed by the FFT circuit 18. A control signal computing circuit 20 serves to compute an amount of control for the phases of transmitting radio waves to be transmitted from the element antennas 1a and 1b in accordance with the following formula 2 in order to have the beams of transmitted radio waves correspond to the direction of arrival 13 of incoming radio waves detected by the incoming radio wave arrival direction detecting circuit 19, viz., to make the equiphase front 14 of the incoming radio waves coincide with the equiphase front of the transmitted radio waves.

$$\psi_i = k_2(x_i \sin\theta \cos\phi + y_i \sin\theta \sin\phi) \quad (2)$$

where $i=1$ to n; n is the number of element antennas 1a and 1b; $x_i$ and $y_i$ are the coordinates of the element antennas 1a and 1b; $\theta$ and $\phi$ are the coordinates of the direction of arrival 13 of the incoming radio waves detected by the incoming radio wave arrival direction detecting circuit 19 as shown in FIG. 4; and $k_2$ is the constant determined by the frequency of transmitted radio waves.

The signal processor 8 outputs the control quantity calculated by the control signal computing circuit 20 in serial fashion after adding identification codes to each transmitting system as a control signal. As in the case of the receiving mode, the transmission of control signals to the transmitting system is effected in such a manner that the electric signals are converted into optical signals by means of the electro-optical converter 5c with a view to attaining high-speed transmission thereof, and the optical signals are converted into electric signals by the photoelectric converter 7c just before being fed to the transmitting system. Here, since only one optical fiber 6c is used for the transmission of control signals to the transmitting system, the identification codes are added to the control signals for each transmission system, and then the control signals are reformed in series. After the optical signals have been converted into the electric signals by means of the photoelectric converter 7c, the corresponding control signals are allocated to the respective transmitting systems in accordance with the identification codes. The control signals transmitted to the respective transmitting systems are held by the registers 9a and 9b. The phases of transmitted radio waves sent from the feed system 10 are varied by the phase-shifters 11a and 11b in accordance with the control signals held in the registers 9a and 9b. The transmitting radio waves whose phases are changed by the phase-shifters 11a and 11b are amplified by the transmitters 12a and 12b, and unnecessary radio waves thereof are at the same time eliminated. The transmitted radio waves travel via the duplexers 2a and 2b and are then transmitted from the element antennas 1a and 1b. At this time, the phase-shifters 11a and 11b change the phases of transmitted radio waves on the basis of the control signals coming from the signal processor 8 so that the equiphase front of the transmitted radio waves coincides with the equiphase front 14 of the incoming radio waves. As a result, the beams of transmitted radio waves are radiated in the same direction as the direction of arrival 13 of incoming radio waves.

Even if the frequency of transmitted radio waves is different from that of incoming radio waves, the beams of transmitted radio waves can be radiated in the same direction as the direction of arrival 13 of the incoming radio waves because the phase-shifters 11a and 11b can be adapted to the frequency of the transmitted radio waves.

The above-described embodiment utilizes two element antennas 1a and 1b. Even when an arbitrary plural number of element antennas are employed, however, the same effects can also be obtained.

In the above-mentioned embodiment, the description has been focused on a case where the element antenna 1a is defined as a reference of the equiphase front. If another arbitrary element antenna serves as the basis, however, the same effects can be exhibited.

According to the explanation of the foregoing embodiment, the direction of arrival 13 of incoming radio waves is arranged to be unidirectional. However, similar effects can be acquired with respect to incoming radio waves coming from other arbitrary directions.

Additionally, a single optical fiber 6c is used in the aforementioned embodiment for transmitting the control signal from the signal processor 8 to the transmitting system. However, the same effects can be obtained with respect to a combination incorporating a plurality of similar transmitting systems.

In accordance with the above-described embodiment, a piece of optical fiber 6a or 6b is employed for transmission of the incoming signals of one receiving system. Where the incoming signals of a plurality of receiving systems are transmitted through one optical fiber, the same effects can also be exhibited.

In the foregoing embodiment, the optical fibers 6a, 6b and 6c are utilized both for transmission of the incoming signals of a receiving system and for transmission of the control signals of a transmitting system. However, similar effects can be achieved in a case where the control signals and the incoming signals are transmitted as electric signals in just the transmitting system or the receiving system, or in both the transmitting system and receiving system.

Furthermore, in the above-described embodiment, the signal processor 8 incorporates the digital detecting circuits 17a and 17b, the Fast Fourier Transform (FFT) circuit 18, the incoming radio wave arrival direction detecting circuit 19 and the control signal computing circuit 20; that is the signal processor 8 is constituted by all these circuits. However, it will be apparent to those skilled in the art that a part or all of such components may be replaced by software subroutines to obtain the same effects.

As discussed above, in accordance with the present invention, the phase-shifter is installed in the transmitting system of the plurality of transmitting/receiving element antennas, while the analog-to-digital converter for converting the received signals into digital signals is disposed in the receiving system. In addition, the receiving system is equipped with the signal processor for computing the control signals of the transmitting system on the basis of the digital signals from the receiving system. With this arrangement, direction of arrival of the incoming radio waves is detected, and even if the frequencies of the transmitted and incoming radio waves are different from each other, the beams of transmitted radio waves can be automatically radiated in the same direction as the direction of arrival of the incoming radio waves.

Although the illustrative embodiment of the present invention has been described in great detail with reference to the accompanying drawings; it is to be understood that the invention is not limited to the precise embodiment shown. Various changes or modifications may be effected thereto by one skilled in the art without departing from the scope or spirit of the invention.

What is claimed is:

1. An antenna system comprising:

a plurality of transmitting/receiving element antennas;

a plurality of transmitting/receiving means, each respectively coupled to one of said antennas, for transmitting and receiving radio waves, each of said transmitting/receiving means comprising:

a receiver responsive to said one antenna for receiving radio waves, a transmitter coupled to said one antenna for transmitting radio waves, a duplexer, coupled to said one antenna, for alternately coupling one of the transmitter and receiver to said one antenna, an analog-to-digital converter, coupled to the receiver, for converting the received radio waves into digital signals, an electro-optical converter, coupled to the analog-to-digital converter, for converting said digital signals into optical signals, a first optical transmission means, coupled to the electro-optical converter, for transmitting said optical signals, a photo-electric converter, coupled to said optical transmission means, for converting the optical signals into digital signals representative of the received radio waves, a phase-shifter, coupled to the transmitter, for supplying phase-shifted radio waves to the transmitter, and a register, coupled to the phase-shifter, for supplying digital control signals to the phase-shifter;

a signal processor, responsive to each of the photo-electric converters for simultaneously processing said digital signals from each of said transmitting-/receiving means, said signal processor comprising control signal computing means for generating a plurality of control signals to control the phase shifter in each of the transmitting/receiving means so that beams of transmitted radio waves may be radiated in the same direction as the direction of arrival of received radio waves, and an identification code insertion means for adding an identification code to each of said control signals and then forming the control signals in series, each of said identification codes identifying one of said transmitting/receiving means;

a system electro-optical converter, coupled to the signal processor, for converting the control signals into optical control signals;

a second optical transmission means, coupled to the system electro-optical converter, for transmitting said optical control signals and associated data;

a system photo-electric converter, coupled to the second optical transmission means, for converting the optical control signals to digital control signals;

control signal allocation means for allocating each of the digital control signals to the register of a transmitting/receiving means in accordance with the identification codes; and a feed means, coupled to the phase-shifter of each of the transmitting/receiving means, for feeding the radio waves to be transmitted.

2. The antenna system of claim 1 wherein the signal processor further comprises:

digital detecting means for detecting the phases and amplitudes of said received radio waves on the basis of the digital signals received from each of the photo-electric converters;

Fast Fourier transform means for computing the intensities of said received radio waves in every direction on the basis of the phases and amplitudes detected by the digital detecting means; and a direction detector means, responsive to the Fast Fourier transform means, for detecting the direction of arrival of said received radio waves, wherein the control signal computing means is responsive to the direction detector means.

3. An antenna system comprising:

a plurality of transmitting/receiving element antennas;

a plurality of transmitting means for transmitting radio waves including at least data signals, each respectively coupled to one of said antennas;

each of said transmitting means including a phase-shifter;

a plurality of receiving means for receiving radio waves including at least data signals, each receiving means respectively coupled to one of said antennas;

each of said receiving means comprising means defining a signal receiving path and including a receiver and an analog-to-digital converter for converting received signals into digital signals, said signal receiving path being absent any phase-shifter;

a signal processor intercoupled between said analog-to-digital converter and said phase-shifter for simultaneously digitally processing received digital signals respectively sent from each analog-to-digital converter, said signal processor comprising means for detecting a direction of arrival of said received radio waves and means responsive to said detected direction for correspondingly controlling said phase-shifters in said transmitting means by control signals generated by said signal processor so that beams of transmitted radio waves may be radiated in the same direction as said direction of arrival of said received radio waves even when the frequency of said received radio waves is outside the frequency band of said transmitted radio wave, wherein said phase-shifters are active only during the transmission of radio waves by said transmitting means and said plurality of element antennas;

wherein said signal processor further comprises means for adding an identification code to each of said control signals and then forming the control signals in series, each of said identification codes identifying one of said transmitting means; and control signal allocation means for allocating each of the control signals to a transmitting means in accordance with said identification code.

4. An antenna system comprising:

a plurality of transmitting/receiving element antennas;

a plurality of transmitting means for transmitting radio waves at a transmission frequency $f_1$ within a transmission frequency band, each transmitting means respectively coupled to one of said antennas;

each of said transmitting means including a phase-shifter;

a plurality of receiving means for receiving radio waves at a reception frequency $f_2$ within a reception frequency band, each receiving means respectively coupled to one of said antennas;

each of said receiving means comprising means defining a signal receiving path including a receiver and including an analog-to-digital converter for converting received signals into digital signals, said signal receiving path being absent any phase-shifter;

a plurality of duplexers, each of said duplexers intercoupling one of said transmitting means and one of said receiving means with one of said element antennas, each of said duplexers separating radio waves being received from radio waves being transmitted;

a signal processor intercoupled between said analog-to-digital converter and said phase-shifter for simultaneously digitally processing received digital signals respectively sent from each analog-to-digital converter, said signal processor comprising means for detecting a direction of arrival of said received radio waves and means responsive to said detected direction for correspondingly controlling said phase-shifters in said transmitting means by control signals generated by said signal processor so that beams of transmitted radio waves may be radiated in the same direction as said direction of arrival of said received radio waves even when the reception frequency $f_2$ is outside the transmission frequency band and the transmission frequency $f_1$ is outside said reception frequency band, wherein said phase-shifters are active only during the transmission of radio waves by said transmitting means and said plurality of element antennas;

wherein said signal processor further comprises means for adding an identification code to each of said control signals and then forming the control signals in series, each of said identification codes identifying one of said transmitting means; and control signal allocation means for allocating each of the control signals to a transmitting means in accordance with said identification code.

* * * * *